US005828391A

United States Patent [19]

Shinozaki et al.

[11] Patent Number: 5,828,391

[45] Date of Patent: Oct. 27, 1998

[54] THERMAL TRANSFER RECORDING DEVICE

[75] Inventors: Kenji Shinozaki; Hideki Hirano, both of Kanagawa; Masanori Ogata, Saitama, all of Japan

[73] Assignee: Sony Corporation, Tokyo, Japan

[21] Appl. No.: 743,920

[22] Filed: Nov. 5, 1996

Related U.S. Application Data

[63] Continuation-in-part of Ser. No. 399,640, Mar. 7, 1995, abandoned.

[30] Foreign Application Priority Data

Mar. 8, 1994 [JP] Japan ..... 6-036933

[51] Int. Cl.[6] ..... B41J 2/05

[52] U.S. Cl. ..... 347/51; 347/171

[58] Field of Search ..... 347/51, 171

[56] References Cited

U.S. PATENT DOCUMENTS

| | | | |
|---|---|---|---|
| 5,561,451 | 10/1996 | Ogata et al. | 347/51 |
| 5,592,208 | 1/1997 | Shinozaki et al. | 347/171 |
| 5,594,480 | 1/1997 | Sato et al. | 347/51 |

FOREIGN PATENT DOCUMENTS

| | | |
|---|---|---|
| 0 243 118 A2 | 10/1987 | European Pat. Off. . |
| 0 321 922 A2 | 6/1989 | European Pat. Off. . |
| 0 354 706 A2 | 2/1990 | European Pat. Off. . |
| 0 375 433 A2 | 6/1990 | European Pat. Off. . |
| 0 549 244 A1 | 6/1993 | European Pat. Off. . |
| 0 577 527 A1 | 1/1994 | European Pat. Off. . |
| 2 142 583 | 1/1985 | United Kingdom . |

OTHER PUBLICATIONS

Patent Abstracts of Japan, vol. 12, No. 159 (M–770), 2 Dec. 1988 & JP–A–63 183860 (Ricoh) 29 Jul. 1988.

Patent Abstracts of Japan, vol. 17, No. 336 (M–1435), 25 Jun. 1993 & JP–A–05 042764 (Nikon) 23 Feb. 1993.

Coffe, William L., "Flash Transfer of Liquid Ink From a Back Screened Donor", Xerox Disclosure Journal, vol. 2, No. 3, May/Jun. 1977, p. 33.

Woodward, D. H., "Distillation Printing", IBM Technical Disclosure Bulletin, vol. 9, No. 11, Apr. 1967, p. 1592.

Patent Abstracts of Japan, vol. 8, No. 216 (M–329), 3 Oct. 1984 & JP–A–59 101398 (Matsushita) 11 Jun. 1984.

*Primary Examiner*—Huan H. Tran

*Attorney, Agent, or Firm*—Hill & Simpson

[57] ABSTRACT

A thermal transfer recording device in which a gap is provided between a layer of a transfer dye and an object of transfer recording and in which the transfer dye is supplied to a transfer section and subsequently vaporized by heating so as to be transferred onto the object of transfer recording wherein, with the density of the transfer dye ρ, the surface tension of the transfer dye γ and with the period of heating ω, a unit width d of a spatial structure of the transfer section is given by $$0.8n\pi(\gamma/\rho\omega^2)^{1/3} < d < 1.2n\pi(\gamma/\rho\omega^2)^{1/3}$$

where n is a positive integer. With the present thermal transfer recording device, a high-quality color image can be produced easily.

18 Claims, 3 Drawing Sheets

THERMAL TRANSFER RECORDING DEVICE

This application is a continuation-in-part of application Ser. No. 08/399,640, filed Mar. 7, 1995, now abandoned.

BACKGROUND OF THE INVENTION

This invention relates to a thermal transfer recording device in which a transferred image having a continuous gradient may be formed by transferring a transfer dye to an object by a suitable heat source depending in image signals.

Up to now, a thermal transfer recording device, in which an object, such as a photographic paper, and a thermal transfer recording medium, such as an ink sheet, are superimposed one on the other and selectively heated, depending on image signals, using heating means, such as laser or a thermal head, for transferring the transfer dye from the recording medium to the object for recording an image thereon, has been used extensively.

Above all, the so-called sublimation thermal transfer recording device, employing a thermally diffusible dye, such as sublimable dye, as the transfer dye, is small-sized, and permits facilitated maintenance and instantaneous recording. In addition, the device gives a recorded image exhibiting a sufficient gradient and high quality comparable to a halide color photograph. For this reason, the device is attracting attention in connection with the technology of providing a hard copy of an image of a video camera, television or computer graphics.

An ink ribbon so far used for thermal transfer recording comprises a transfer dye mixed with a suitable binder resin at a mixing ratio by weight of 1:1 to give a coating which is applied on a substrate of e.g., a polyester film to a thickness on the order of 1 $\mu$m. However, since the ink ribbon is usually discarded after use, a large quantity of waste material is produced thus raising a problem in connection with environmental protection.

Thus an attempt has been made for improving the utilization efficiency of the thermal transfer recording medium. The demand may be met by, for example, the transfer dye layer regenerating method or the repeated rotational transfer dye layer constituting method, in which the transfer dye layer of the thermal transfer recording layer is regenerated and repeatedly utilized, and a relative speed method, in which the thermal transfer recording medium may be utilized effectively.

However, since the above methods are of the type in which the dye is transferred by the transfer dye layer being pressed against the photographic paper, there is unavoidably presented a problem that, for producing a color image, the dye transferred to the object is transferred back to the transferred dye layer thus deteriorating the picture quality and marring the image.

A device has been proposed in which a gap is provided between the transfer dye layer and the photographic paper for transferring the dye without contacting the transfer dye layer with the photographic paper. The transfer dye is supplied to the transferred area by being allowed to flow in the molten state or by being continuously applied on a suitable substrate and thence moved to the transferred area. The transfer dye is vaporized by heating means, such as laser, based on image signals, so as to be transferred to the photographic paper.

However, for carrying out transfer recording by such device, since no binder is contained in the transfer dye, laser radiation leads to generation of the surface wave due to difference in surface tension between the heated portion and the non-heated portion of the transfer dye, thus allowing the dye to be deviated to a surrounding region to render it difficult to vaporize the transfer dye appropriately.

In the thermal transfer recording device in which the gap is formed between the transfer dye layer and the photographic paper and the molten transfer dye is vaporized by heating means, such as laser, so as to be transferred to and recorded on the photographic paper, considerable difficulties are met in vaporizing the transfer dye in the desired manner, although there is no risk of the transferred dye being transferred back to the transfer dye layer.

SUMMARY OF THE INVENTION

In view of the foregoing, it is an object of the present invention to provide a thermal transfer recording device in which the transfer dye may be satisfactorily vaporized depending on image signals so as to be transferred to and recorded on the photographic paper in order to permit a high-quality color image to be produced easily.

The present invention provides a thermal transfer recording device in which a gap is provided between a layer of a transfer dye and an object of transfer recording and in which the transfer dye is supplied to a transfer section and subsequently vaporized by heating means so as to be transferred onto the object of transfer recording. According to the present invention, the transfer section in which the molten transfer dye is vaporized has a spatial structure having a unit width d defined by the equation:

$$0.8n\pi(\gamma/\rho\omega^2)^{1/3}<2d<1.2n\pi(\gamma/\rho\omega^2)^{1/3} \quad (1)$$

where $\rho\gamma$, $\omega$ and $\omega$ are the density of the transfer dye, surface tension of the transfer dye and the period of heating of the transfer dye by the heating means, respectively, and n is a positive odd integer.

That is, the thermal transfer recording device according to the present invention has the spatial structure having the unit width d represented by the equation (1).

The heating means for the transfer dye may be constituted by laser.

The heating means for the transfer dye may also be constituted by a thermal head.

Since the thermal transfer recording device of the present invention has the spatial structure having the unit width d represented by the equation (1), it becomes possible to suppress the generation of the surface wave on vaporization of the transfer dye melted by the heating means.

That is, a gap is provided between the transfer dye layer and the photographic paper in order to prevent contact therebetween, and the molten transfer dye is vaporized by being heated by the semiconductor laser so as to be transferred as an image from the transfer section via the gap onto the photographic paper. Since the transfer dye needs to be vaporized by being heated instantaneously, the surface wave is generated due to the difference in surface tension between the heated and unheated portions of the transfer dye. However, since the unit width d of the spatial structure formed in the transfer section is within an allowable range 0.8 d to 1.2 d, wherein d is ¼ n $\times\lambda/2$, and n is a positive odd integer, the surface wave and the spatial structure cooperate to cancel the surface wave, thus promptly attenuating the surface wave. Consequently, the surface wave unavoidably generated by instantly heating the transfer dye may be promptly suppressed substantially completely, thus prohibiting the transfer quantity of the transfer dye to the photographic paper from being lowered.

DESCRIPTION OF THE PREFERRED EMBODIMENTS

Figure 1:
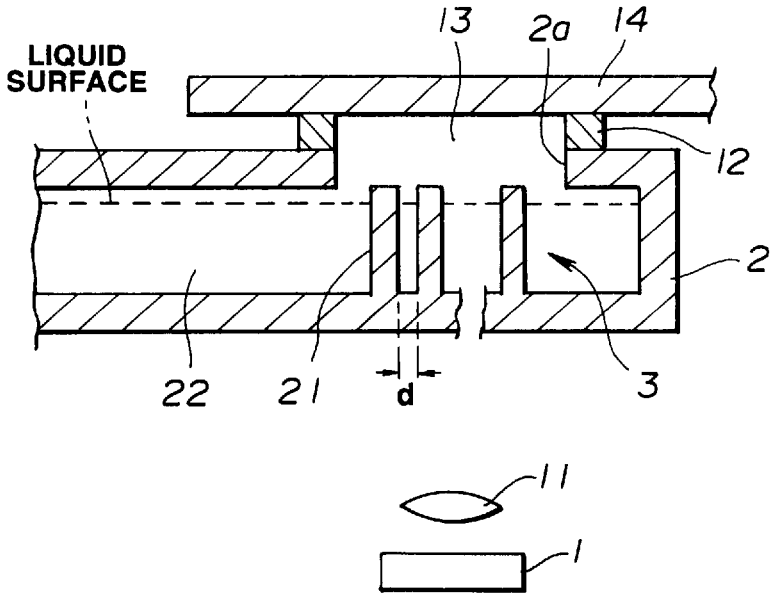
FIG. 1 is a schematic cross-sectional view showing essential parts of a thermal transfer recording device according to a first embodiment of the present invention.

Referring to the drawings, preferred embodiments of the present invention will be explained in detail. With the thermal transfer recording device, an object to be transferred, such as a photographic paper, and a thermal transfer recording medium, such as an ink sheet, are superimposed one on the other, and are selectively heated by heating means, such as laser or thermal head, in accordance with image signals, for transferring the transfer dye from the thermal transfer recording medium to the object in accordance with image signals for image recording.

The thermal transfer recording device according to the first embodiment includes, as main components, a semiconductor laser 1 as heating means for vaporizing the transfer dye in the molten state, and a dye vat 2 of glass for containing the transfer dye therein.

The transfer dye is prepared by adding 2 wt % of a laser light absorber manufactured by MITSUI TOATSU CO. LTD. under the trade name of HM1225 to a dispersion dye exhibiting physical properties of the density $\rho=1.0$ g/cm$^2$ and the surface tension $\gamma=20$ dyne/ cm at a temperature of 250° C. and by heating the resulting mixture to 160° C. to a molten state.

Figure 2:
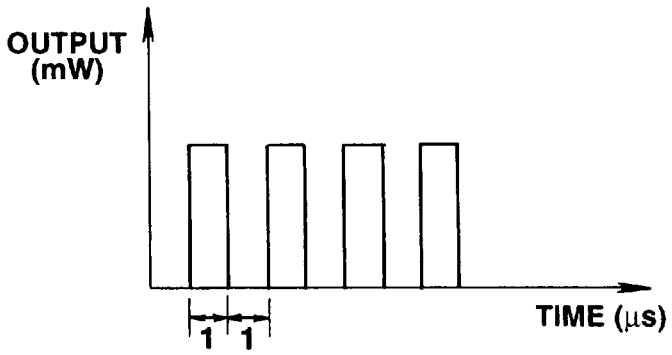
FIG. 2 is a graph showing time changes of a laser light output of a semiconductor laser.

The semiconductor laser 1 is adapted for radiating a pulsed laser beam with a period of 2 $\mu$s, a light emission wavelength of 780 nm and an output of 40 mW, as shown in FIG. 2. The focal length of a lens 11, an optical system for the laser light beam, is set to 5×10 $\mu$m. The state of dispersion of the surface wave, generated at this time by the difference in surface tension between the portions of the transfer dye heated and not heated by the laser light, is shown by the equation $$\omega^2=(\gamma k^3)/\rho \tag{2}$$

where k stands for the number of waves and $\omega$ stands for the pulse period of the laser light. Thus the wavelength $\lambda$ of the surface wave may be represented by the equation $$\lambda=2\pi(\rho\omega^2)^{1/3} \tag{3}$$

From the above equation (2), the angular frequency of the surface wave becomes $\omega=2\pi\times5\times10^5$ rad/s. The transfer dye is instantaneously heated to 250° C. on laser radiation, so that, from the equation (3), the wavelength $\lambda$ of the surface wave becomes equal to 8.0 $\mu$m.

The dye vat 2 is in the shape of a shallow casing in which a molten transfer dye is stored to form a transfer dye layer 22. The upper surface of the dye vat 2 is partially opened to form an aperture 2*a* of a pre-set area, while the lower surface thereof has a transfer section 3 in registration with the aperture 2*a*. A spacer 12 is formed around the rim of the aperture 2*a* for defining a gap 13 and a photographic paper 14 as an object of transfer recording is placed on the spacer 12. Thus the transfer section 3 is arranged with a pre-set distance corresponding to the gap 13 from the photographic paper 14 without being in physical contact therewith.

Figure 3:
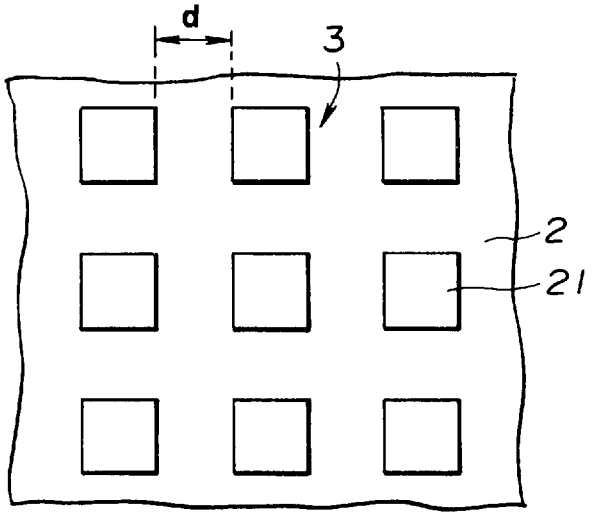
FIG. 3 is a schematic plan view showing a partial construction of a transfer portion of the thermal transfer recording device.

The transfer section 3 has a periodic spatial structure comprising plural pillars 21 of a substantially square cross-section set upright at equal intervals from one another on the portion of the lower surface of the dye vat 2 in registration with the aperture 2*a*. Each pillar 21 has a height above the liquid surface of the transfer dye in the dye vat 2 and faces the aperture 2*a*, as shown in FIG.3.

Figure 4:
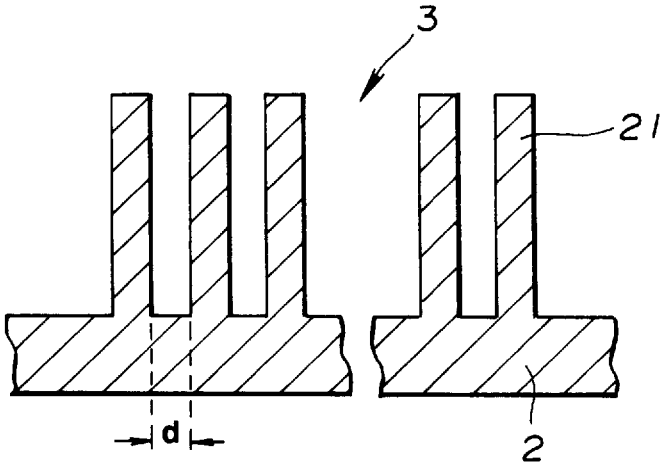
FIG. 4 is a schematic cross-sectional view showing a partial construction of a transfer portion of the thermal transfer recording device.

Referring to the spatial structure of the transfer section 3, as shown in FIG.4, the width of each pillar 21 and the interval between adjacent pillars 21 are both set to 2 $\mu$m. That is, the unit distance d (=2 $\mu$m), which is equal to the spacing between adjacent surfaces of pillars and which corresponds to a period of the spatial structure, is selected to be equal to one-half the wavelength $\lambda$ of the surface wave generated by the difference in surface tension between the heated and non-heated portions of the transfer dye on laser light radiation.

With the above-described thermal transfer recording device of the above-described first embodiment, having the spatial structure having the unit width d corresponding to one period as represented by the equation (1), it becomes possible to inhibit generation of the surface wave on vaporizing the transfer dye melted by laser radiation from the laser semiconductor 1.

More specifically, with the above arrangement in which the gap 13 is provided between the transfer dye layer 22 and the photographic paper 14 in order to prevent contact therebetween, and in which the molten transfer dye is vaporized by being heated by the semiconductor laser 1 so as to be transferred as an image from the transfer section 3 via the gap 13 onto the photographic paper 14, since the transfer dye needs to be vaporized by being heated instantaneously, the surface wave is generated due to the difference in surface tension between the heated and unheated portions of the transfer dye. However, since the unit width d corresponding to spacing between adjacent surfaces of pillars 21 of the spatial structure formed in the transfer section 3 is equal to $\frac{1}{4}n\times\lambda/2$, wherein n is a positive odd integer, the surface wave and the pillars 21 cooperate to cancel the surface wave, thus promptly attenuating the surface wave. Consequently, the surface wave unavoidably generated by instantly heating the transfer dye may be suppressed substantially completely in a short time, thus preventing the transfer quantity of the transfer dye to the photographic paper 14 from being lowered.

Referring to the spatial structure, it is preferred for the unit width d to be in an allowable range of 0.8d to 1.2d, wherein d equals $\frac{1}{4}\ n\times\lambda/2$, wherein n is a positive odd integer. If the unit width d exceeds the above range, the surface wave attenuating effect is lowered significantly since it becomes impossible to disregard the deviation between the wavelength $\lambda$ of the surface wave and the unit width d.

Measurements of the image transfer quantity were conducted using the thermal transfer device according to the first embodiment. It was found that the transfer dye was transferred to an area of 80 $\mu$s×80 $\mu$m of the photographic paper 14 per msec in an amount of OD 2.2 as measured with a Macbeth densitometer. In addition, the transferred quantity was increased in proportion to the transfer time.

Several comparative embodiments are now given in connection with the measurement of the image transfer quantity in the first embodiment. In the first comparative embodiment, the image transfer quantity was measured under the condition that the unit width d corresponding to one period of the spatial structure of the transfer section 3 was set to 3 μm, that is the width of each pillar 21 and the interval between the pillars 21 were both set to 1.5 μm, with the remaining values being the same as those of first embodiment. It was found that only the transfer dye corresponding to OD 1.2 as measured by the Macbeth densitometer was transferred per msec on an area of 80 μm×80 μm. It was also found that the dot OD was not changed with prolonged transfer time, although the dot diameter on the photographic sheet 14 was increased.

Then, by way of a second comparative embodiment, the image transfer quantity was measured under the condition that the pulse period of the laser light of the semiconductor laser 1 was set to 20 μs, that is the wavelength λ of the surface wave was set to 3.7 μm, with the remaining values being the same as those of the first embodiment. It was found that only the transfer dye corresponding to OD 1.1 as measured by the Macbeth densitometer was transferred per msec on an area of 80 μm×80 μm. It was also found that the dot OD was not changed with prolonged transfer time, although the dot diameter on the photographic sheet 14 was increased.

Thus, with the above-described first embodiment of the thermal transfer recording device, the image transfer quantity is substantially twice that in case the spatial structure in the transfer section 3 is outside the range of the equation (1), thus enabling the high-quality color image to be produced easily.

The thermal transfer recording device according to the second embodiment is now explained. The parts and components similar to those of the previous embodiment are correspondingly numbered.

The second embodiment is substantially similar to the first embodiment, with the exception that the spatial structure of the transfer section is different from that of the previous embodiment.

Figure 5:
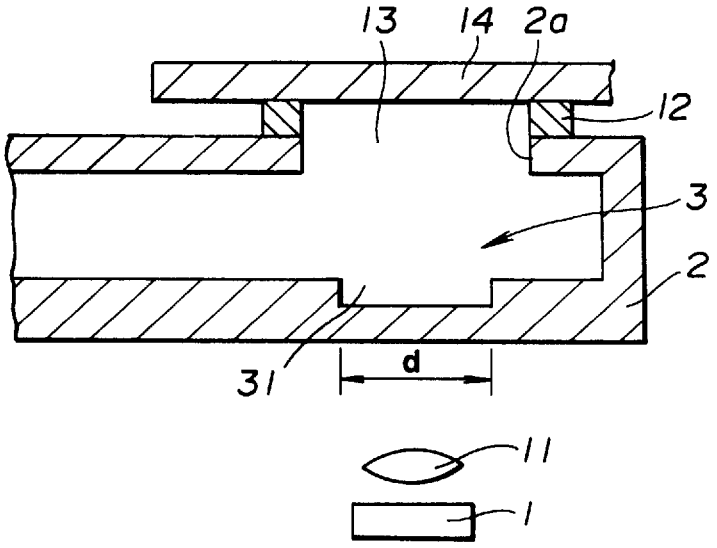
FIG. 5 is a schematic cross-sectional view showing essential parts of a thermal transfer recording device according to a second embodiment of the present invention.

The transfer section 3 of the thermal transfer recording device of the present embodiment has a groove 31 in the lower bottom surface of the dye vat 2 in registration with the aperture 2*a*, as shown in FIG. 5.

The groove 31 has a width d, a unit width, equal to 75 μm, and a depth of 20 μm, and is filled with the transfer dye in the molten state. The semiconductor laser 1, as heating means for the transfer dye, is so set that the pulse period of the laser light id 20 μs, that is the wavelength λ of the surface wave, as derived from the equations (1) and (2), is equal to 3.7 μm.

With the above-described thermal transfer recording device of the second embodiment, having the spatial structure with the unit width d as represented by the equation (1), it becomes possible to inhibit generation of the surface wave on vaporizing the transfer dye melted by laser radiation from the laser semiconductor 1.

More specifically, with the above arrangement in which the gap 13 is provided between the transfer dye layer 22 and the photographic paper 14 in order to prevent contact therebetween, and in which the molten transfer dye is vaporized by being heated by the semiconductor laser 1 so as to be transferred as an image from the transfer section 3 via the gap 13 onto the photographic paper 14, since the transfer dye needs to be vaporized by being heated instantaneously, the surface wave is generated due to the difference in surface tension between the heated and unheated portions of the transfer dye. However, since the unit width d of the groove 31 of the spatial structure formed in the transfer section 3 is equal to $\frac{1}{4}n\times\lambda/2$, wherein n is a positive odd integer, the surface wave and the groove 31 cooperate to cancel the surface wave, thus promptly attenuating the surface wave. Consequently, the surface wave unavoidably generated by instantly heating the transfer dye may be suppressed substantially completely in a short time, thus prohibiting the transfer quantity of the transfer dye to the photographic paper 14 from being lowered.

Measurements of the image transfer quantity were conducted using the thermal transfer device according to the second embodiment. It was found that the transfer dye was transferred to an area of 80 μs×80 μm of the photographic paper 14 per msec in an amount of OD 2.0 as measured with a Macbeth densitometer. In addition, the transferred quantity was increased in proportion to the transfer time.

Another comparative embodiment (third comparative embodiment) is now given in connection with measurement of the image transfer quantity in the second embodiment. In the third comparative embodiment, the image transfer quantity was measured under the condition that the width d of the groove 31 as a unit width in the spatial structure of the transfer section 3 was set to 65 μm, which was not 44 of an odd integer number times the half wavelength of the surface wave, with the remaining values being the same as those of second embodiment. It was found that only the transfer dye corresponding to OD 1.4 as measured by the Macbeth densitometer was transferred per msec on an area of 80 μm×80 μm. It was also found that the dot OD was not changed with prolonged transfer time, although the dot diameter on the photographic sheet 14 was increased.

Thus, with the above-described second embodiment of the thermal transfer recording device, the image transfer quantity is slightly less than twice that in case the spatial structure in the transfer section 3 is outside the range of the equation (1), thus enabling the high-quality color picture to be produced easily.

Figure 6:
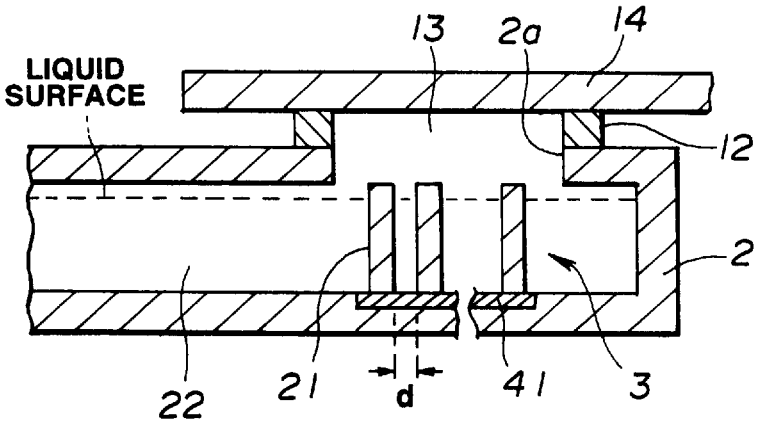
FIG. 6 is a cross-sectional view showing essential portions of a thermal transfer recording device employing a thermal head according to the present invention.

The present invention is not limited to the above-described first or second embodiments. For example, a thermal head may be employed in place of the semiconductor laser as heating means for the transfer dye. FIG. 6 shows an embodiment of the present invention in which the thermal head is employed. The thermal head shown in FIG. 6 has a heater 41, such as a resistor, below the pillar 21 provided in the dye vat 2.

The spatial structure of the transfer section 3 may be constituted by holes or the wall on a concentric circle, instead of by the pillars 21 or the groove 31, provided that the equation (1) is satisfied.

What is claimed is:

1. A thermal transfer recording device comprising:

a dye container including a bottom wall and an opposed top wall with a transfer opening having a dye-receiving cavity defined therein and a transfer section in said dye-receiving cavity adjacent and aligned with said transfer opening, a molten vaporizable transfer dye composition disposed in said dye-receiving cavity and a surface wave suppressing structure comprising a plurality of upstanding pillars having a square cross-section arranged in an array of equally spaced columns and rows defined in said transfer section within the area circumscribed by the transfer opening adjacent to the transfer opening and configured to substantially suppress any surface wave generated on vaporizing transfer dye in the transfer section.

2. A thermal transfer recording device as defined in claim 1, wherein said dye container comprises glass.

3. A thermal transfer recording device as defined in claim 1, wherein a surface of a first pillar is spaced from an adjacent surface of an adjacent second pillar by a spacing d, wherein d may vary from about 0.8d to about 1.2d and d=¼ n×λ/2, wherein n is a positive odd integer and λ is the wavelength of a surface wave generated by vaporizing transfer dye in the transfer section.

4. A thermal transfer recording device as defined in claim 1, wherein a surface of a first pillar is spaced from an adjacent surface of an adjacent second pillar by a spacing, d, wherein $$0.8n\pi(\gamma/\rho\omega^2)^{1/3}<2d<1.2n\pi(d\gamma/\rho\omega^2)^{1/3}$$

wherein ρ is the density of the transfer dye, γ is the surface tension of the transfer dye, ω is the heating period and n is a positive odd integer.

5. A thermal transfer recording device as defined in claim 1, wherein transfer dye is vaporized in said transfer section by laser light transmitted through the dye container opposite said transfer opening.

6. A thermal transfer recording device as defined in claim 1, wherein transfer dye is vaporized in said transfer section by a thermal head provided in said dye container opposite said transfer opening.

7. A thermal transfer recording device as defined in claim 1, wherein said vaporizable transfer dye composition comprises a mixture of a vaporizable transfer dye and a laser light absorber.

8. A thermal transfer recording device as defined in claim 1, wherein each upstanding pillar has a top surface and has a height dimension such that the top surfaces of the upstanding pillars are disposed at the transfer opening in the area circumscribed by the transfer opening.

9. A thermal transfer recording device comprising:

a dye container including a top wall with a transfer opening having a dye-receiving cavity defined therein and a transfer section in said dye-receiving cavity adjacent and aligned with said transfer opening, a spacer member peripherally disposed about the transfer opening and projecting upwardly from the top wall for providing a transfer gap between said transfer opening and a surface of a printing substrate on which a thermal transfer image is to be recorded, a molten vaporizable transfer dye composition disposed in said dye-receiving cavity and a surface wave suppressing structure comprising a plurality of upstanding pillars having a square cross-section section arranged in an array of equally-spaced columns and rows defined in said transfer section within the area circumscribed by the transfer opening adjacent to the transfer opening configured to substantially suppress any surface wave generated on vaporizing transfer dye in the transfer section.

10. A thermal transfer recording device comprising:

a dye container including a top wall with a transfer opening having a dye-receiving cavity defined therein and a transfer section in said dye-receiving cavity adjacent and aligned with said transfer opening, a spacer member peripherally disposed about the transfer opening and projecting upwardly from the top wall for providing a transfer gap between said transfer opening and a surface of a printing substrate on which a thermal transfer image is to be recorded, a molten vaporizable transfer dye composition disposed in said dye-receiving cavity and a surface wave suppressing structure comprising a groove recess defined in said dye container opposite said transfer opening and in registration therewith having a depth dimension and a width dimension configured to substantially suppress any surface wave generated on vaporizing transfer dye in the transfer section.

11. A thermal transfer recording device comprising: a dye container including a top wall with a transfer opening having a dye-receiving cavity defined therein and a transfer section in said dye-receiving cavity adjacent and aligned with said transfer opening, a molten vaporizable transfer dye composition disposed in said dye-receiving cavity and a surface wave suppressing structure comprising a plurality of upstanding pillars provided within the area circumscribed by the transfer opening adjacent to the transfer opening configured to substantially suppress any surface wave generated on vaporizing transfer dye in the transfer section.

12. A thermal transfer recording device as defined in claim 11, wherein said dye container comprises glass.

13. A thermal transfer recording device as defined in claim 11, wherein said surface wave suppressing structure comprises a plurality of upstanding pillars having a square cross-section arranged in an array of equally-spaced columns and rows.

14. A thermal transfer recording device as defined in claim 13, wherein a surface of a first pillar is spaced from an adjacent surface of an adjacent second pillar by a spacing d, wherein d may vary from about 0.8d to about 1.2d and d=¼ n×λ/2, wherein n is a positive odd integer and λ is the wavelength of a surface wave generated by vaporizing transfer dye in the transfer section.

15. A thermal transfer recording device as defined in claim 13, wherein a surface of a first pillar is spaced from an adjacent surface of an adjacent second pillar by a spacing, d, wherein $$0.8n\pi(\gamma/\rho\omega^2)^{1/3}<2d<1.2n\pi(d\gamma/\rho\omega^2)^{1/3}$$

wherein ρ is the density of the transfer dye, γ is the surface tension of the transfer dye, ω is the heating period and n is a positive odd integer.

16. A thermal transfer recording device as defined in claim 11, wherein transfer dye is vaporized in said transfer section by laser light transmitted through the dye container opposite said transfer opening.

17. A thermal transfer recording device as defined in claim 11, wherein transfer dye is vaporized in said transfer section by a thermal head provided in said dye container opposite said transfer opening.

18. A thermal transfer recording device as defined in claim 11, wherein said vaporizable transfer dye composition comprises a mixture of a vaporizable transfer dye and a laser light absorber.

* * * * *